US007832711B2

(12) United States Patent
Miyoshi et al.

(10) Patent No.: US 7,832,711 B2
(45) Date of Patent: Nov. 16, 2010

(54) CONTROL SYSTEM FOR TRANSFER MEANS

(75) Inventors: Takanori Miyoshi, Hamamatsu (JP); Kazuhiko Terashima, Toyohashi (JP); Etsuzo Kawai, Toyokawa (JP)

(73) Assignees: Sintokogio, Ltd., Aichi-ken (JP); Toyohashi University of Technology, Aichi (JP)

( * ) Notice: Subject to any disclaimer, the term of this patent is extended or adjusted under 35 U.S.C. 154(b) by 348 days.

(21) Appl. No.: 11/667,940

(22) PCT Filed: Nov. 18, 2005

(86) PCT No.: PCT/JP2005/021279

§ 371 (c)(1),
(2), (4) Date: Nov. 9, 2007

(87) PCT Pub. No.: WO2006/054712

PCT Pub. Date: May 26, 2006

(65) Prior Publication Data

US 2008/0265225 A1 Oct. 30, 2008

(30) Foreign Application Priority Data

Nov. 19, 2004 (JP) ..... 2004-335500
Nov. 19, 2004 (JP) ..... 2004-335721

(51) Int. Cl.
*B66D 1/00* (2006.01)

(52) U.S. Cl. ..... 254/270; 254/166; 212/285; 414/5

(58) Field of Classification Search ..... 254/266, 254/270, 264, 274, 331, 360, 361, 362
See application file for complete search history.

(56) References Cited

U.S. PATENT DOCUMENTS 5,865,426 A * 2/1999 Kazerooni ..... 254/270

(Continued)

FOREIGN PATENT DOCUMENTS

JP 54-108352 A 8/1979

(Continued)

*Primary Examiner*—Evan H Langdon
(74) *Attorney, Agent, or Firm*—Finnegan, Henderson, Farabow, Garrett & Dunner L.L.P.

(57) ABSTRACT

A control system comprising a force measuring means (3) for measuring the magnitude of the force acting on a lower part of the rope suspending a load, which force is caused by a force imposed on the load by an operator, the mass of the load, and an acceleration of the load; a first control means (4) having a first computing unit, the first computing unit computing a rotational direction and a velocity of a servomotor to be driven, based on the measured result from the force measuring means, and outputting a signal that corresponds to the measured result to the servomotor, a length measuring means for measuring the length of a rope (2) wound down from a hoist drum; a weight measuring means for measuring the weight of the load suspended from the rope; an angle measuring means for measuring the angle of the rope relative to a vertical plane when the operator laterally pushes the load; and a second control means having a second computing unit, the second computing unit computing the operation conditions for the crane based on the measured information from the length measuring means, the weight measuring means, and the angle measuring means, and outputting a signal that corresponds to the measured result to the crane.

4 Claims, 8 Drawing Sheets

U.S. PATENT DOCUMENTS

| | | | | |
|---|---|---|---|---|
| 5,915,673 | A * | 6/1999 | Kazerooni | 254/270 |
| 6,299,139 | B1 * | 10/2001 | Kazerooni | 254/270 |
| 6,386,513 | B1 * | 5/2002 | Kazerooni | 254/270 |
| 6,554,252 | B2 * | 4/2003 | Kazerooni et al. | 254/270 |
| 6,622,990 | B2 * | 9/2003 | Kazerooni | 254/270 |
| 6,681,638 | B2 * | 1/2004 | Kazerooni et al. | 73/760 |
| 6,886,812 | B2 * | 5/2005 | Kazerooni | 254/270 |
| 7,334,776 | B2 * | 2/2008 | Kazerooni | 254/270 |
| 2002/0100899 | A1 * | 8/2002 | Kazerooni | 254/266 |

FOREIGN PATENT DOCUMENTS

| | | | |
|---|---|---|---|
| JP | 58-139988 | A | 8/1983 |
| JP | 63-165295 | A | 7/1988 |

* cited by examiner (a) PD controller (b) PI controller

CONTROL SYSTEM FOR TRANSFER MEANS

TECHNICAL FIELD

The present invention relates to a control system for an elevating device or transfer means. Specifically, it relates to a control system in a transfer means that moves a load with an assist force of an operator in the operator's desired direction and at the operator's desired velocity when the operator imposes the force (an operating physical force) on the load, which load is suspended by a rope in a position or is vertically moved by winding a hoist drum up and down in one direction and a reverse direction by a servomotor driven in those directions, or which load is horizontally carried by a crane.

BACKGROUND ART

A Japanese prior-art published patent, JP H11-147699A, discloses a control system for a device that vertically transfers a load. This load-transfer device includes a mechanism for vertically carrying the load, a drive source for driving the mechanism, and a control part and a handling part, for controlling the drive source, and further includes a control system, wherein a sensor provided in the handling part detects the magnitude of the lifting force of an operator created when he or she holds the handling part and pushes the load upward against the gravity, and the hoisting power of the load-transfer device is amplified in response to the magnitude of the lifting force of the operator, thereby vertically moving the load by the amplified hoisting power and the lifting force. That control system in the load-transfer device controls the amount of air to be supplied to a cylinder by always or approximately increasing the ratio of the hoisting power to the lifting force as the lifting force become greater.

When this control system is used, for example, to manually carryout aligning and fitting the bushings of a cope on the pins of a drag for mating them, it is necessary to place the cope, which is suspended by an overhead traveling crane or the like, just above the drag first by depressing or controlling the operating buttons of the control panel of the crane first, and then necessary to lower the cope onto the drag.

On the other hand, there is a power assistance system developed as a research power assistance system for use in factories (as taught in "Development of the Power Assistance System for Transportation" by Hisashi Nakamura, the System Integration Division Science Lecture Meeting '01, Lecture Meeting Thesis Collection 2001, pp. 515-516), where the man's operating physical force (imposed force) is measured by a force sensor to obtain an assistance force (supplementary force) that will correspond to the imposed force. Further, other power assistance systems are known, such as one (as taught in "Trial for Safety of Skill Assistance" by Youji Yamada, the System Integration division Science Lecture Meeting '01, Lecture Meeting Thesis Collection 2001, pp. 519-520), where the skill assistance (technological assistance) is carried out considering not only reducing the burden of the worker but also his or her operational feeling, and the COBOTO ("Cobots for the Automobile Assembly Line" by P Akella, Proc. IEEE Int. Conf. Rob Autom 1999, pp. 728-733), where a man operates the system with an acceleration pedal and a steering wheel.

However, since in the former control system of the device for hoisting the load the instructions for moving the load at a velocity and in a direction are given by handling an operating lever by a operator, which lever is disposed apart from the load, the operator cannot simultaneously hold the load and operates the lever, giving the operator a non-excellent operational feeling when he or she hoists the load. Further, in a cope-and-rag mating operation, the cope sways when it is moved to a position above the drag, causing a difficulty with mating them precisely. Accordingly, the operator had to repeatedly depress the buttons of a control panel to precisely position the cope relative to the drag. This was inefficient. Further since the operator had to operate with his or her both hands simultaneously holding the cope and the control panel, the operation was difficult, causing a problem in that the physical burden on him or her would be great.

Further, since in the latter power assistance system a sensor for measuring the operational physical force imposed on the load by the operator is disposed in a position separated from the load, he or she cannot direct touch the load or cannot feel a response from it when he or she operates to transfer it. Accordingly, an excellent operational feeling is not given. Further, since the power assistance system requires a special-purpose device, it cannot be introduced in the existing overhead traveling cranes used in factories.

Further, since in the control systems for the conventional devices for hoisting a load or the conventional transfer means the instructions for moving the load in a given direction and at a given velocity are to be generated by operating the operation lever by the operator, he or she cannot simultaneously holds the load and operate it, causing a problem in that he or she cannot hoist the load in an excellent operational feeling.

Further, since in a cope-and-drag mating operation, the cope sways when it is moved to a position above the drag, causing a difficulty with mating them precisely and requiring repeated fine adjustments of the position of the cope by depressing the buttons of a control panel many times. This was inefficient. Further since the operator has to operate with his or her both hands simultaneously holding the cope and the control panel, the operation is extremely difficult, causing a problem in that the physical burden on him or her will be great.

Further, there were problems in that the operator cannot hoist the load in an excellent operational feeling, and in that further the operator cannot horizontally move the load, since he or she simultaneously carries out both holding the load and operating the control lever.

DISCLOSURE OF THE INVENTION

The present invention aims to solve the prior-art problems discussed above.

The control system for an elevating or hoisting device of the first embodiment of the present invention is a system for controlling a servomotor so as to vertically move a load in an operator's desired direction and at the operator's desired velocity when the operator imposes a force on the load, which load is suspended in a position by a rope or is vertically moved by winding the rope up and down by the servomotor driven in one direction and a reverse direction, comprising: a force measuring means for measuring the magnitude of the force acting on a lower pant of the rope that is caused by the imposed force of the operator, the mass of the load, and an acceleration of the load; and a control means having a computing unit, the computing unit computing a direction and a velocity of the servomotor to be driven, based on the measured result from the force measuring means, and outputting a signal that corresponds to the measured result to the servomotor.

It the system so arranged, when the operator imposes a force on the load to raise or lower the load in the operator's desired directions, the force measuring means measures the magnitude of the force acting on the lower part of the rope, which force is caused by the imposed force of the operator, the mass of the load, and a force due to the acceleration of the load, and send the measured result to the control means. The control means then computes a rotational direction and a velocity for the servomotor to be driven from the measured result from the force measuring means, which rotational direction and velocity correspond to the measured result, and then sends a directional signal to the servomotor to drive it. Accordingly, a force that corresponds to the force imposed by the operator is added to the load, and this assists the operator, so that the load is moved in the operator's desired direction and at the operator's desired velocity.

Further, in an operation of placing a filling frame on a flask, when the operator imposes a force or forces on the filling frame to move it vertically, horizontally, and/or frontward and rearward directions to place it on the flask, the force measuring means measures the magnitude of the force generated by the imposed force by the operator, the mass of the cope, and the acceleration of the cope, and then send the measured result to the control means. The control means then computes a rotational direction and a velocity for the servomotor to be driven from the measured result from the force measuring means, which rotational direction and velocity correspond to the measured result. Accordingly, a force that corresponds to the force imposed by the operator is added to the cope, and this assists the operator, so that the cope is moved in the operator's desired direction and at the operator's desired velocity.

In the first embodiment of the present invention, by storing in the computing unit a controller Kf represented by the expression $Kf=kp\omega n2/(s2+2\zeta\omega ns+\omega n2)$, the computing unit can compute an elevating velocity for a minimum time due to the controller Kf based on the measured information from the force measuring means, namely, the information on the force caused by the mass of the load, the imposed force by the operator, and the acceleration of the load, so that the system is not dispersed even if a resonance such as a sway of the load is caused.

With this arrangement of the first embodiment, the operator can simultaneously carries out both holding the load and operating it, generating a practicable great effect in that the operator can obtain an excellent operational feeling and can elevate the load in his or her desired direction and at the desired velocity.

A control system for a transfer means, of the second embodiment of the present invention, is a control system for a transfer means that carries a load with an assist force of an operator when the operator imposes the assist force on the load as an operating physical force, in the operator's desired direction at the operator's desired velocity, which load is suspended by a rope in a position or is vertically moved by winding the rope up and down by a hoist drum driven in one direction and a reverse direction by a servomotor driven in those directions, and which load is horizontally transferred by a crane, comprising a force measuring means for measuring the magnitude of the force acting on a lower part of the rope, which force is caused by the imposed force of the operator, the mass of the load, and an acceleration of the load; a first control means having a first computing unit, the first computing unit computing a rotational direction and a velocity of the servomotor to be driven, based on the measured result from the force measuring means, and outputting to the servomotor a signal that corresponds to the measured result to drive the servomotor. a length measuring means for measuring the length of the rope wound down from the hoist drum; a weight measuring means for measuring the weight of the load suspended from the rope; an angle measuring means for measuring the angle of the rope relative to a vertical plane when the operator laterally pushes the load; and a second control means having a second computing unit, the second computing unit computing operation conditions for the crane based on the measured information from the length measuring means, the weight measuring means, and the angle measuring means, and outputting to the crane a signal that corresponds to the computed result to drive the crane.

In the control system so arranged, when an operator imposes a force on a load, which has a given weight, and which is suspended by a given length of a rope, which is in turn wound down from a hoist drum, so as to raise or lower the load in a desired direction, the force measuring means measures the magnitude of a force acting on the rope generated by the imposed force by the operator, the mass of the load, and an acceleration of the load, and the sends the measured result to the first control means. When receiving the measured result from the force measuring means, the first control means computes a rotational direction and a velocity for the servomotor to be driven that correspond to the measured result and then sends an instruction signal to the servomotor to drive it. Accordingly, the operator can raise or lower the load in his or her desired direction and at the desired velocity with the added force corresponding the operator's imposed force.

Further, when the operator horizontally pushes the load, which has a given weight, and which is suspended by a given length of the rope, the information on the length the wound-down rope from the length measuring means, the information on the weight of the load form the weigh measuring means, and the information on the swaying angle of the rope at that time from the angle measuring means, are input to the second control means. An electric power that is necessary to move the crane in the direction to cancel the swaying angle of the rope at that time is input to the electric motor of the crane. Accordingly, the operator can horizontally transfer the load by directly operating it in the high operative condition.

Further, in the second embodiment of the present invention, by storing in the computing unit the controller Kf represented by the expression $Kf=kp\omega n2/(s2+2\zeta\omega ns+\omega n2)$, the computing unit can compute an elevating velocity for a minimum time due to the controller Kf based on the measured information from the force measuring means, namely, the information on the force caused by the mass of the load, the imposed force by the operator, and the acceleration of the load, so that the system is not dispersed even if a resonance such as a sway of the load is caused.

Due to the second embodiment so arranged, a practicable great effect is produced in that the operator can elevate the load in the desired direction and at the desired velocity while obtaining an excellent operational feeling, and further, he or she can horizontally transfer it in the high operative condition, while directly operating it.

BEST MODE FOR CARRYING OUT THE INVENTION

The best mode for carrying out the invention is now explained with reference to the accompanying drawings, where the invention is applied to a transfer means, the winding-up machine of which is installed in an overhead traveling crane. The mode is explained for a load that includes a flask-tight mold that holds therein a mold or a mold with a core or cores. This mode is similarly applicable to a cope flask.

As shown in FIG. 1, in the winding-up machine for elevating a load, or an object, W, the rotary shaft of a hoisting drum (not shown) for winding a rope 2 up is connected to the output shaft of a servomotor 1 that is driven to rotate the hoisting drum in one direction and a reverse direction. Further, a load cell 3 as a force measuring means for measuring the force acting on the lower end of the rope 2 is secured to the lower end of the rope 2, which is wound down from the hoisting drum (not shown). The load W is securely suspended from the bottom of the load cell 3 through, for example, a hook (not shown). Further, a first control means 4 is electrically coupled to the load cell 3. The first control means 4 includes a computer, or a first computing unit, for computing a rotational direction and a velocity for the servomotor 1 to be driven based on the measured result from the force measuring means 3. The first control means 4 also sends to the servomotor 1 a directional signal created based on the computed result of the computer.

Further, as shown in FIG. 2, the hoist drum for winding the rope up and down is mounted on a truck 6 of the overhead traveling crane. In addition, a second control means 7 is attached to the overhead traveling crane. The second control means 7 includes a length measuring means (not shown) for measuring the length of the rope 2 wound down from the hoist drum; a weight measuring means (not shown) for measuring the weight of load W suspended by the rope 2; an angle e measuring means (not shown) for measuring the swaying angle of the rope 2 that is formed relative to a vertical plane when an operator pushes the load; and a computer, or a second computing unit, for computing the travelling conditions for the overhead traveling crane based on the information from the length measuring means, the weight measuring means, and the angle measuring means. The second control means 7 also sends to the overhead crane a directional signal created from the computed result of the computer. Further, the load W is moved by the overhead traveling crane when the operator laterally push it.

The operation of this transfer means is now explained for the case where the operator transfers the load W to an arbitrary place using the transfer means arranged as explained above. First, the procedure for raising or lowering a load W, which is suspended by a rope 2, in the operators desired direction and at the operator's desired velocity by pushing the load W upward or downward by the operator is explained. When the operator pushes the load W upward or downward, the load cell 3 measures the magnitude of the force acting on the rope 2 and sends it to the first control means 4. The computer of the first control means 4 then carries out some necessary computations on the basis of the following principle so as to assist the operator for elevating the load W by the winding-up machine through the winding-up machine to elevating of load W.

Specifically, in that basic principle the load cell 3 detects the force fm [N] when the operator imposes an operational physical force fh [N] to load W as shown in FIG. 3, and the controller Kf generates a control input u (i.e., an directional velocity, rv [m/s]). Accordingly, the winding-up machine moves the load W up or down according to the directed velocity v. The letter m denotes the mass [kg] of the load W. The downward direction of the z axis assumed positive.

The above action is performed by the following theory. Specifically, the following relational expression is established.

The controlled elevating velocity for the load W, $$v=rv=Kffm \tag{1}$$

Since the force fm is here the value of the operational physical force fh minus the apparent weight due to the acceleration dv/dt of the load, it is expressed as follows:

$$fm=fh-mdv/dt \tag{2}$$

Thus the load W obtains the elevating velocity that is expressed by the following transfer function due to the operational physical force fh.

$$Rv(s)=Kf(s)Fh(s)/[1+msKf(s)] \tag{3}$$

where s is a Laplacian operator [1/s], and Fh is the imposed operational physical force [N]. Therefore, the operator can elevate the load with his or her less force if the gain of Kf(s) is made greater.

Now, from the operational physical force the coefficient of transformation kp [(m/s/N)] of the winding-up or winding-down velocity is defined as the controller's parameter, which velocity is to be the controlled velocity rv=kpfh of the load W in the steady state, where kp denotes the transfer velocity [m/s] per the unit operational physical force (1[N]).

This variable is decided depending on user requirements. A less kp may be selected if the transfer velocity of the load W is made less to perform a more precise positioning of it, or a greater kp may be selected if the load is to be carried at a higher velocity by a less force.

Further, the following expression is obtained if the variation in the resonance frequency of the winding-up machine and its peak gain are considered as multiplication variations.

$$\tilde{P}=P(1+\Delta) \tag{4}$$

In expression (4), P with an upper wave bar is an actual transfer function, P is a normal transfer function expressed by P(s)=Fm(s)/Rv=ms, and Δ is a variation.

Further, the relation between the modeling error margin and the estimate of the weight function is shown in FIG. 4. If the thin line in the left chart of FIG. 4 is supposed as the transfer function that estimates Δ, the thick line in the left chart of FIG. 4 is obtained for the robust stability as $$Wr=\omega ps/\omega c(s+\omega p) \tag{5}$$

where Wr is a weight function, and |Wr|>Δ.

In FIG. 4, ωc [rad/s] is a cross-angular frequency, and ωp [rad/s] is the frequency at which Δ peaks.

Further, as in this invention, the block diagram for controlling the mixture sensibility problem can be one shown in FIG. 5. Further, the transfer function between w and z is the complementary sensibility function of this system, and the robust stability condition will be $\|Twz\mathbf{2}\|\infty<1$ by considering the weight function Wr. Accordingly, the required controller can be formulated as shown by expression (6).

$$\text{minimize } \|T_{wz1}\|_2 \text{ subject to } \|T_{wz2}\|_{\infty<}1 \tag{6}$$

The transfer function Twz1 between w(=fh) and z1 corresponds to the error margin of the operational physical force fh and the velocity rv of the load. Sine the purpose of this computing means is to design the controller Kf so that it can give the steady velocity kp (m/s/N) as fast as possible for the stepped operational physical force, the weight function Ws is determined as the following expression.

$$Ws=1/s \tag{7}$$

Above-mentioned controller Kf is obtained as follows. Specifically, since the sum of the order of the weight functions Wr, Ws and the normal transfer function P(s) is 2, the optimum controller is secondary. Therefore, the structure of the controller can be expressed as follows:

$$Kf=kp(as2+bs+c)/(s2+2\zeta\omega ns+\omega n2) \tag{8}$$

where a and b are constants, c is a variable, s is a Laplacian operator [1/s], ζ is a damping coefficient, and ωn is a natural angular frequency.

Further, from the viewpoint of the robust stability, a=b=0. If assuming a≠0 and b≠0, there will be a case where the robust stability condition is not satisfied.

To satisfy the expression v=kp f in the steady state, the variable c is obtained as follows.

$$\lim_{s\to 0} sT_{wv_r}(s)\frac{f}{s} = k_p cf/\omega_n^2 = k_p f \qquad (9)$$
$$c = \omega_n^2$$

Accordingly, the analytical solution of the controller will be the following equation.

$$Kf=kp\omega n2/(s2+2\zeta\omega ns+\omega n2) \qquad (10)$$

At this time, the transfer function Twvr, Twz1, and Twz can be expressed as follows.

$$\begin{cases} T_{wv_r} = k_p \dfrac{\omega_n^2}{s^2+2\zeta'\omega_n s+\omega_n^2} \\ T_{wz_1} = \dfrac{s+2\zeta'\omega_n}{s^2+2\zeta'\omega_n s+\omega_n^2} \\ T_{wz} = k_p \dfrac{m\omega_n^2 s}{s^2+2\zeta'\omega_n s+\omega_n^2} \\ \zeta' = \zeta + \dfrac{1}{2}k_p m\omega_n \end{cases} \qquad (11)$$

By the way, since the residual vibration or the transient overshoot of load W is very dangerous, and thus ζ' should be more than 1.0. Accordingly, ζ is restricted as follows.

$$\zeta>1.0-kpm\omega n/2 \qquad (12)$$

Further, from the robustness stability condition the norm |Twz2| of the transfer function is less than 1 as shown below.

$$|T_{wz}W_r| = \left|k_p \frac{m\omega_n^2 s}{s^2+2\zeta'\omega_n s+\omega_n^2}\frac{\omega_p s}{\omega_c(s+\omega_p)}\right| < \frac{k_p m\omega_n^2}{\omega_c}\left|\frac{s^2}{s^2+2\zeta'\omega_n s+\omega_n^2}\right|\left|\frac{\omega_p}{s+\omega_p}\right| < 1 \qquad (13)$$

The second term and the third term are less than 1 under the condition ζ'>=1. Accordingly, the following relation is obtained for ωn.

$$\omega n<\text{the square root of } \omega c/mkp \qquad (14)$$

Further, the controller should be designed so that the H2 norm of Twz1 is minimized. By the simple mathematics, the following expression is obtained from expression (11)

$$\|T_{wz_1}\|_2 = \frac{1}{2}\sqrt{\frac{1}{\omega_n}\left(4\zeta' + \frac{1}{\zeta'}\right)} \qquad (15)$$

For that minimization, ζ' should be as small as possible under the restriction. ζ'>=1.0, and ωn should be as large as possible under the restriction of expression (14). Accordingly, the following is obtained.

$$\begin{cases} \zeta' = 1.0 \\ \omega_n = \sqrt{\dfrac{\omega_c}{mk_p}} \end{cases} \qquad (16)$$

From the above consideration, the optimum robust controller as the computing unit is determined as follows.

$$\begin{cases} K_f = k_p \dfrac{\omega_n^2}{s^2+2\zeta\omega_n s+\omega_n^2} \\ \omega_n = \sqrt{\dfrac{\omega_c}{mk_p}} \\ \zeta = 1.0 - \dfrac{1}{2}k_p m\omega_n \end{cases} \qquad (17)$$

At this time, the optimum H2 norm is expressed as follows.

$$\|T_{wz_1}\|_2 = \frac{\sqrt{5}}{2}\sqrt[4]{\frac{mk_p}{\omega_c}} \qquad (18)$$

The procedure to move the load W, suspended by the rope 2, by horizontally pushing it by the operator, is now explained. When the operator rightwardly pushes the load suspended by the rope 2, the computer of the second control means 7 carries out the following calculations to assist the operator in transferring the load W with the overhead traveling crane.

Specifically, the motion equations of the overhead traveling crane shown in FIG. 2 are expressed by the following equations:

$$m\cdot l^2\cdot d^2\theta/dt^2 - m\cdot l\cdot d^2x/dt^2\cdot\cos\theta + m\cdot l\cdot g\cdot\sin\theta = F\cdot l;\ \text{and}$$
$$p = x + l\cdot\sin\theta,$$

where m [kg] is the mass of the load, l [m] is the length of the rope, g [m/s2] is the gravitational acceleration, θ[rad] is the swaying angle of the rope, x [m] is the position of the truck 6, d2x/dt2[m/s2] is the acceleration of the truck 6, F [N] is the operational physical force of the operator, and p [m] is the position of the load W.

Expression (1) is then linearly approximated by approaching the swaying angle θ to zero (θ→0), and the velocity of the truck 6 is further determined from swaying angle θ [rad] using the feedback gain Kf, as in the expression dx/dt=−Kfθ. Accordingly, the following expression (19) is obtained.

$$\ddot{\theta} = -\frac{K_f}{l}\dot{\theta} - \frac{g}{l}\theta + \frac{1}{ml}F. \qquad (19)$$

Further, the PID control action is carried out in the second control means 7. The term "a PID control action" herein denotes the combination of a P control action, which is a control action where the control input is proportional to the control error, an I control action, which is a control action where the control input is proportional to the integration value of the control error, and a D control action, which is a control action where the control input is proportional to the differentiation value. Accordingly, by replacing Kf in of expression (19) with Kf=Kp+Kds+Ki/s, expressions (20) and (21) are obtained.

$$\theta[s] = \frac{1}{ml}\frac{1}{s^2 + \frac{K_p}{K_d + l}s + \frac{g}{K_d + l}}F[s] \tag{20}$$

$$p[s] = \frac{1}{ms^2}\frac{s^2 + \frac{K_p}{K_d + l}s + \frac{K_1}{K_d + l}}{s^2 + \frac{K_p}{K_d + l}s + \frac{K_i + g}{K_d + l}}F[s] \tag{21}$$

When assuming Ki=0 in expression (21) for simplicity, expression (20) can be transformed into the following expression (22).

$$\begin{cases} \theta[s] = \frac{1}{ml}\frac{1}{s^2 + 2\zeta\omega_n s + \omega_n^2}F[s] \\ \zeta = \frac{K_p}{2\sqrt{(K_d + l)g}},\ \omega_n = \sqrt{\frac{g}{K_d + l}} \end{cases} \tag{22}$$

If the operator imposes an operational physical force on the load W that is suspended by a flexible structure having a small damping resistance such as the rope 2, the residual vibration of the load W may be feared. However, by giving the appropriate Kp by expression (22), ζ becomes greater than 0.707, allowing the load W to be operated with no vibration.

Further, the relation between the transfer velocity by the overhead traveling crane and the operational physical force by the operator becomes dp/dt=Kp/mg·F from expression (21) in ω<<ωn, and the transfer velocity proportional to the operational physical force is obtained.

Further, it is important that the overhead traveling crane reacts well in response to the change in the operational physical force of the operator to lighten his or her burden. In a word, making (on in expression (22) greater will allow the entire overhead traveling crane to quickly react. This will be achieved by setting the derivative gain Kd to be negative within the range of −1<the derivative gain Kd<0 from expression (22).

This can be explained as follows. The derivative gain Kd<0 means that the operator tries to move the truck 1 (the overhead traveling crane) in the direction opposite the direction of the operational physical force. Specifically, when the truck 6 is accelerated leftward in the negative direction in FIG. 2, the swaying angle will be created in the positive (rightward) direction, assisting the operational physical force of the operator who is trying to make a swaying angle in a positive direction.

Further, in the right term of expression (21) both the denominator and the numerator are secondary rational expressions that slightly differ. Accordingly, it can be linearly approximated the same as expression (23) in the area where ω is smaller than con.

$$p[s] = \frac{1}{ms^2}\frac{K_i}{K_i + g}F[s] \tag{23}$$

This expression (23) is just a motion equation of the load W having the mass m·(Ki+g)/Ki [kg] when it is moved with no friction caused. Accordingly, if once the operator imposes the operational physical force F [N] on the load W, it will advance as if it were pushed in the zero gravity.

EXAMPLE OF THE EXPERIMENT

The experimental conditions on the controller are as shown in Table 1.

TABLE 1

Experimental Conditions

| Parameter | Value |
|---|---|
| $k_p$ | 0.002[(m/s)/N] |
| $\omega_n$ | 10.0[rad/s] |
| ζ | 0.697 |
| m | 30.3[kg] |

FIG. 6 shows the properties of the steady state on the operational physical force and the transformation coefficient kp. The results of the experiment were in unison with the theoretical values. For instance, it was confirmed that the load of 30.3 kg in weight was moved at the velocity of 0.06 [m/s] by the operational physical force of 10.0 [N].

Further, in FIG. 7 the operational physical force and the response of the velocity of the load W in that time are shown. The results of the experiment were in unison with the simulation, the load was stably controlled without any vibration, and the validity of the present invention was confirmed.

Example

An operation was carried out for placing a cope flask on a drag flask on the conditions similar to those for the above experiment, wherein both flasks were sized about 0.8 m in width and depth and about 0.4 m in height, weighed about 30 kg, and had pins or bushes for their registration. The cope flask was stably put on the flask with no vibration caused. The operator could raise and lower the flask-tight mold weighing from 10 to 500 kg, while he or she did not feel any burden. However, undesirably the system was sometimes unstably operated when the weight of the flask-tight mold exceeded 500 kg, due to the noise to the operational physical force. Further, the crane is unnecessary if the weight is less than 10 kg.

Further, some experiments were carried out to actually transfer the load W using the overhead traveling crane shown in FIG. 2. The results of the experiments are explained. In the experiments the length of the rope 2 was 1.0 m, and the weight of load W was 10.0 kg. Three types of experiments were carried out, namely, a P control action in which the proportional factor Kp was 5.0, a PD control action in which the proportional factor Kp was 5.0, and the derivative gain Kd was −5.0; and a PI control action in which the proportional factor Kp was 5.0, and the integration gain Ki was 3.0.

The PD control action used herein denotes a combination of a P control action, which is a control action where the control input (the operational physical force) is proportional to the control error, and a D control action, which is a control action where the control input (the operational physical force) is proportional to the differentiation value. Further, the PI control action denotes a combination of the P control action and an I control action, which is a control action where the control input (the operational physical force) is proportional to the integration value of the control error. These gains are set as the values within an appropriate range, since they would be greatly influenced by higher-order modes that do not appear in the model if they were too large.

First, in a transfer experiment that uses the P control action, the operator imposed a staged constant operational physical force, and the transfer velocity of truck 1 (overhead traveling crane) was examined. FIG. 8 shows these experimental values compared with the theoretical values. The experimental values are almost in unison with the theoretical values. It was confirmed that the transfer velocity of the truck 6 was proportional to the operational physical force of the operator.

Further, a transfer experiment that uses the PD control action and a transfer experiment that uses the PI control action were conducted. The results of them are shown in FIGS. 9(*a*) and (*b*), respectively. To verify the validity of the model now, the simulations to which the operational physical forces were applied in the similar manner as in the experiment were superimposed on the results. From FIGS. 9(*a*) and 9(*b*), it is found that in the PD control action the swaying angle and the transfer velocity of the truck 1 that are proportional to the operational physical force of the operator are obtained, and that in the PI control action the load is continuously moved at a constant velocity when the operator imposes the operational physical force once on the load.

Further, it is confirmed that in the experiment for transferring the load of 10 kg in weight the load can be transferred by the operational physical force of 4N at the maximum. Further, though some swaying angle was influenced by the higher-order modes, the behavior of the experiment was in unison with that of the simulation, and the effectiveness of the model was verified.

Further, to verify the effect of the derivative gain, the difference of the behavior of it from the P control action was simulated, and the simulated results were shown in FIG. 11. The effect in the derivative gain is seen in the standing-up way of the swaying angle and in the reverse sway of the velocity of the truck.

INDUSTRIAL APPLICABILITY

The present invention can be used for many places provided with an overhead traveling cane. For instance, it can be used in the molding field for transferring and assembling flask and cores, also for welfare equipments and for the assembly sites in various industries such as assembly of automobiles.

Figure 1:
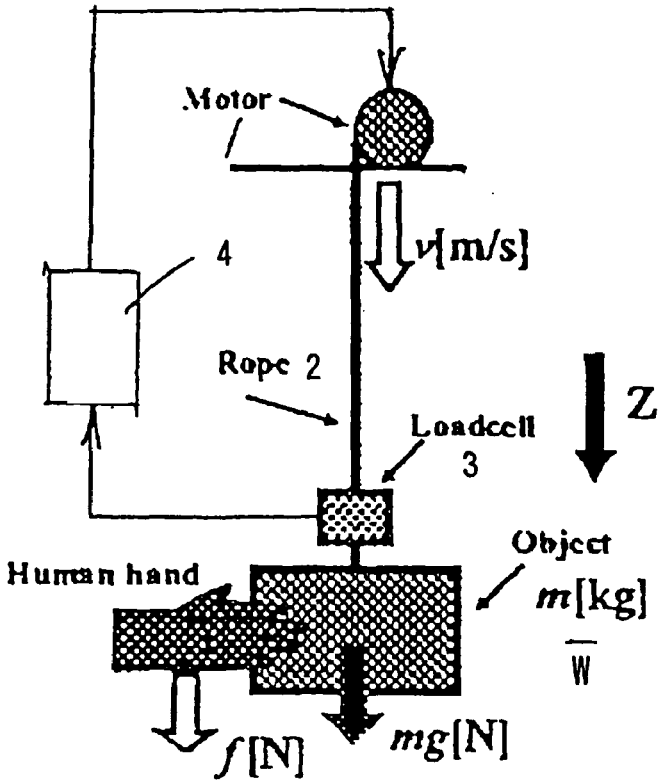
FIG. 1 is a schematic view showing the structure of the best modes of the present invention when a load W is elevated.
Figure 2:
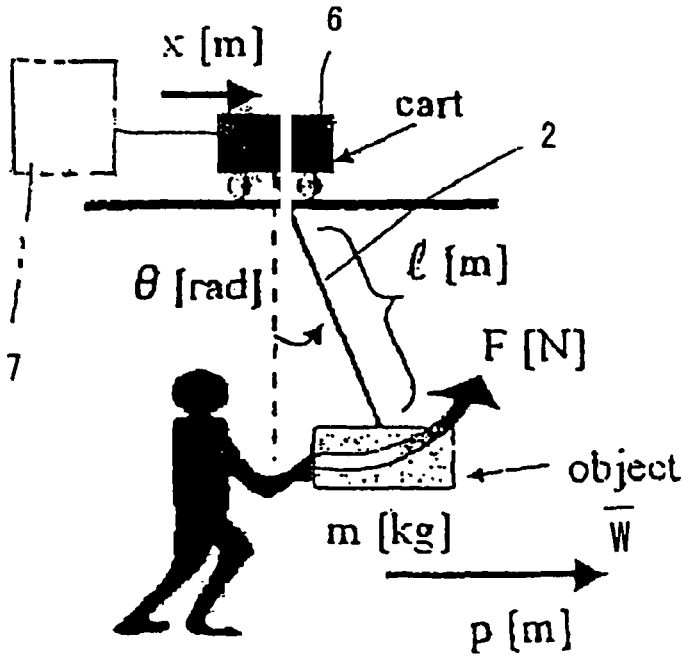
FIG. 2 is a schematic view showing the structure of the best modes of the present invention when a load W is horizontally moved.
Figure 3:
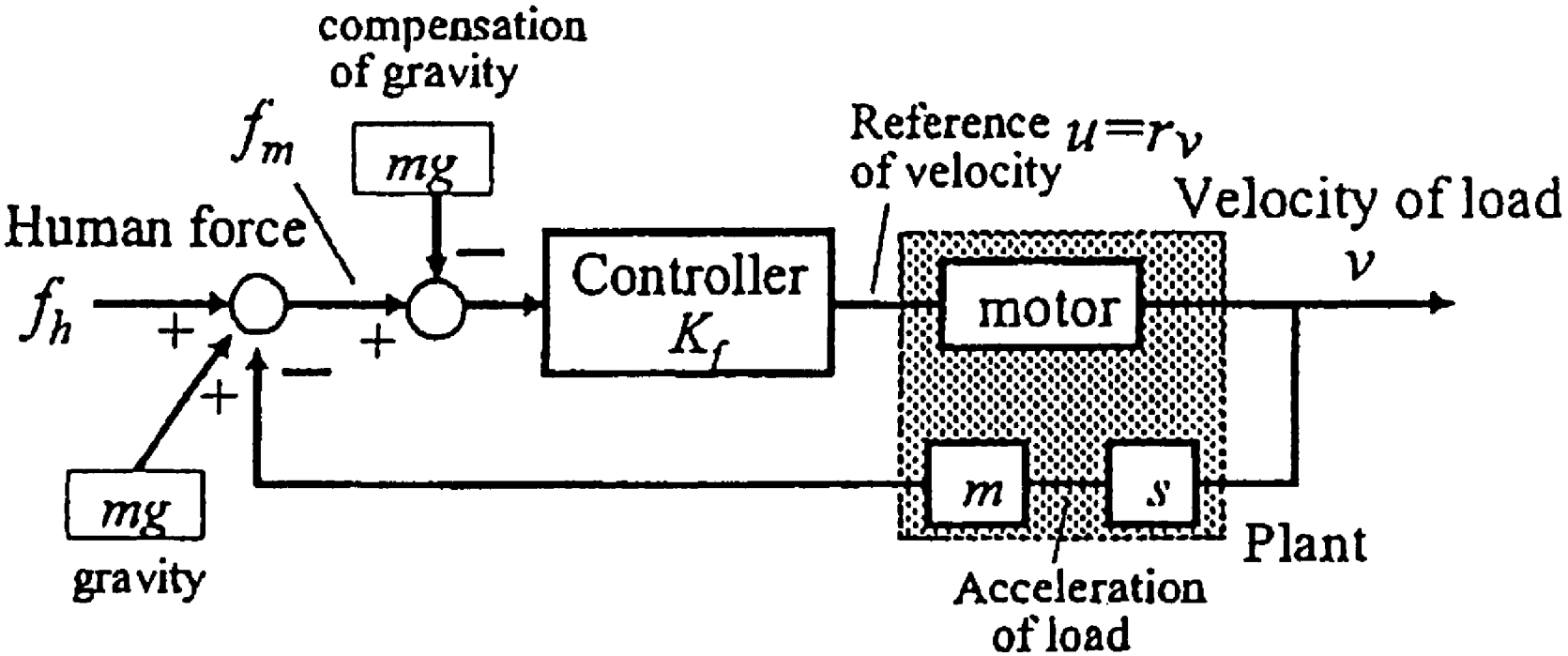
FIG. 3 is a block diagram to control the structure shown in FIG. 1.
Figure 4:
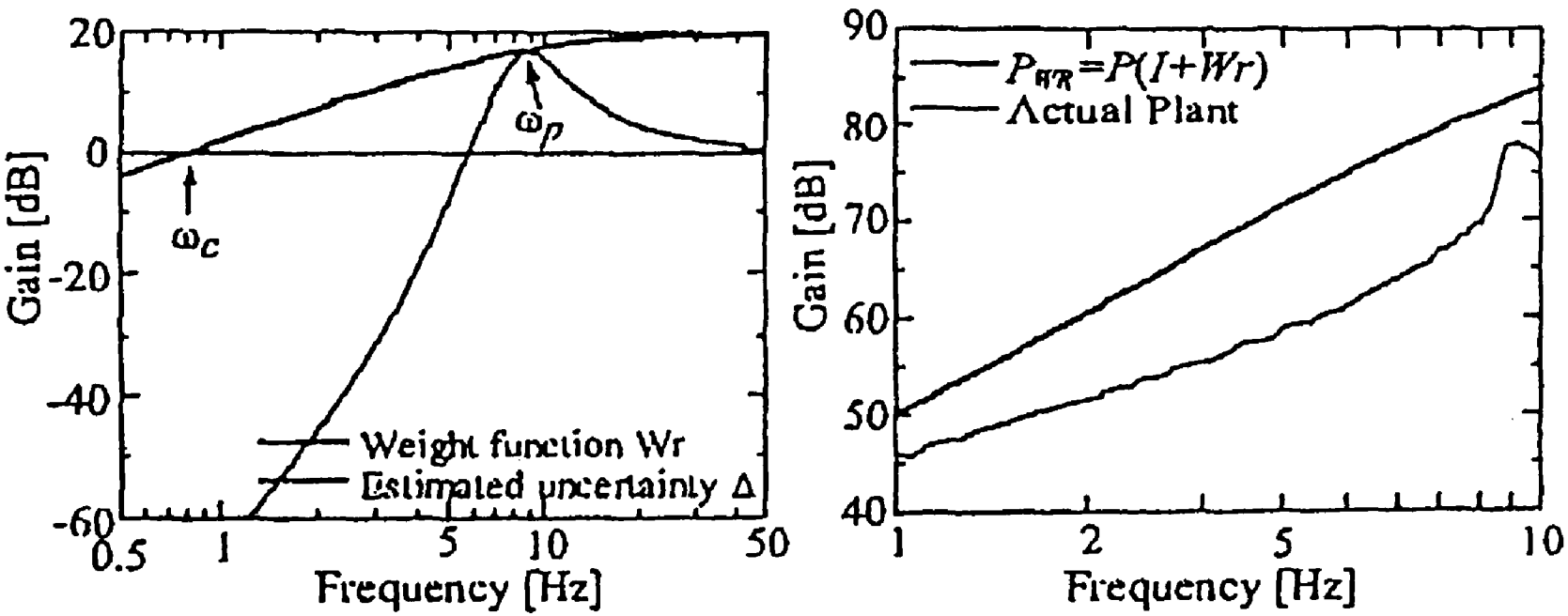
FIG. 4 is a graph showing the relation between the modeling error margin and the estimate of the weight function.
Figure 5:
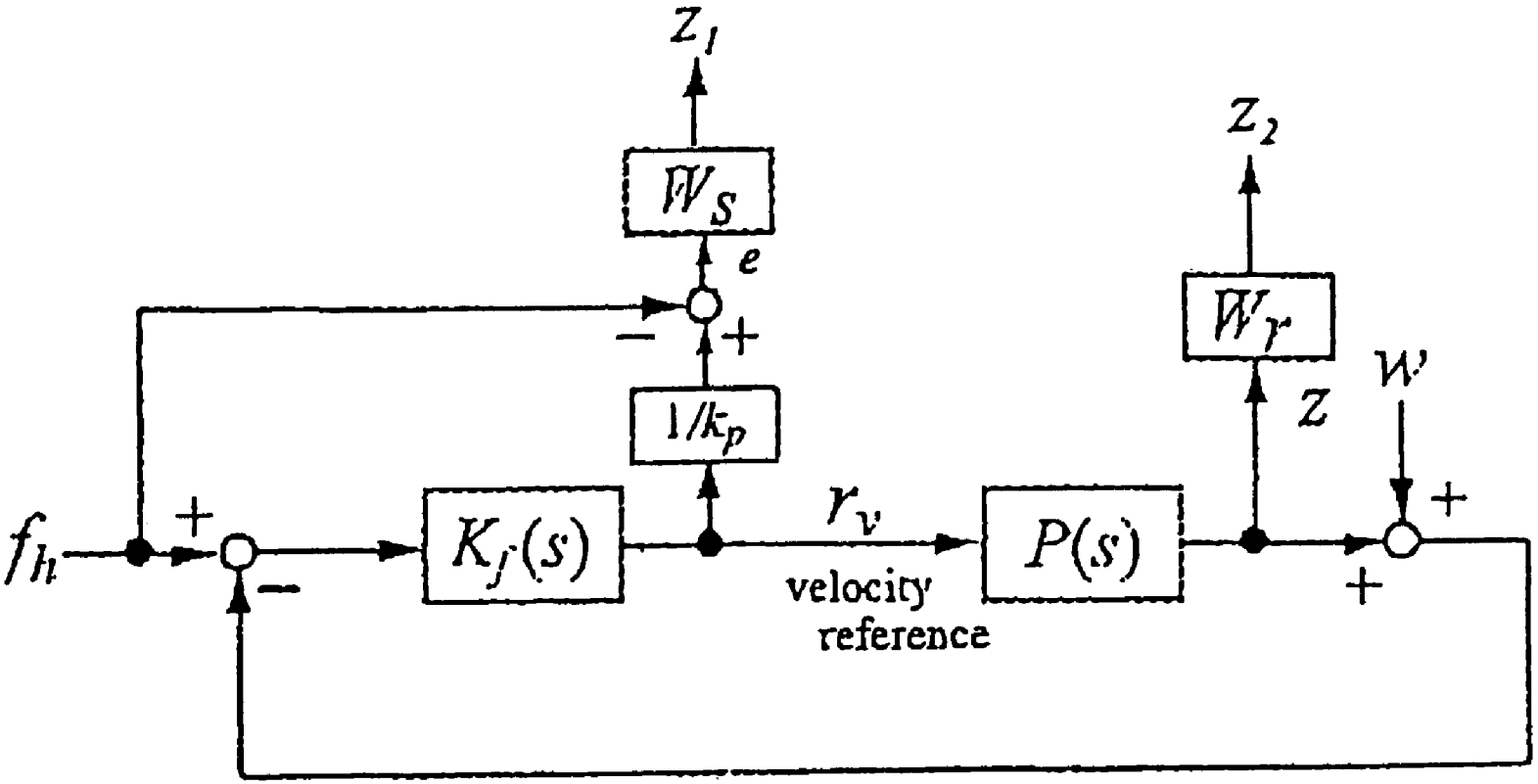
FIG. 5 is a block diagram of the mixture sensibility problem.
Figure 6:
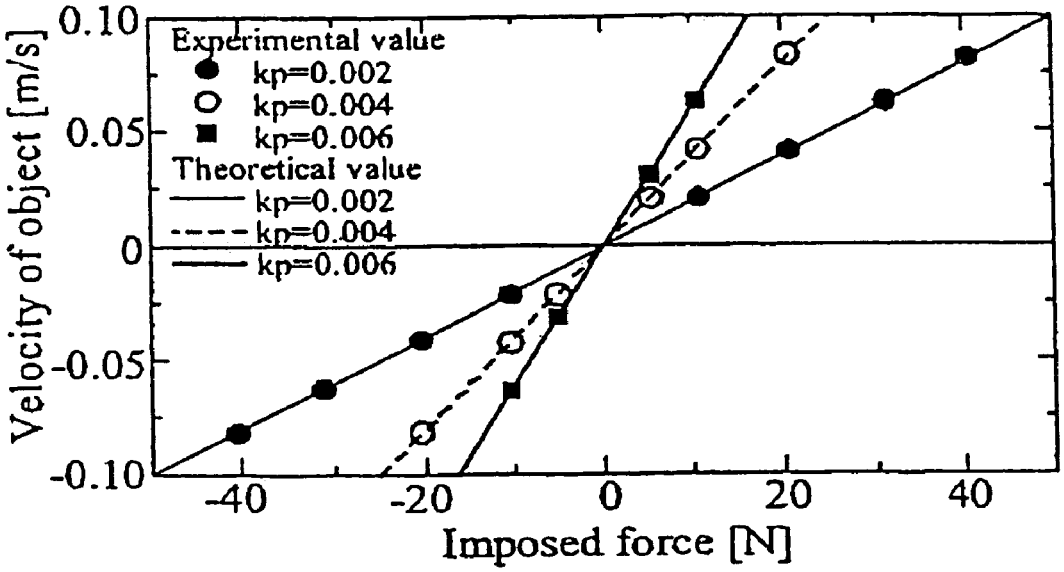
FIG. 6 is a graph showing the relation between the operational physical force and the steady velocity.
Figure 7:
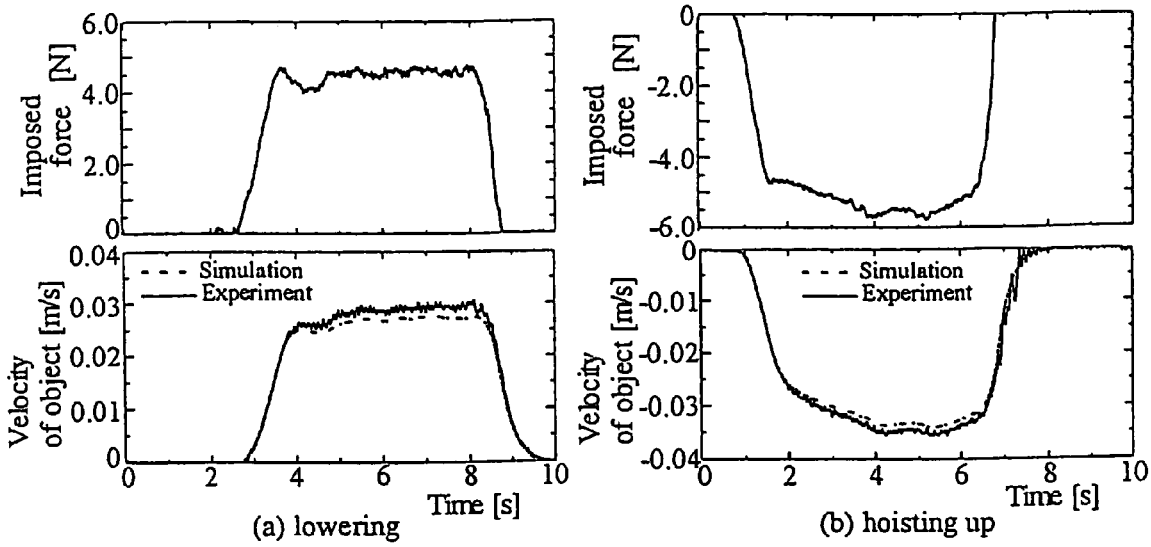
FIG. 7 is a graph showing the state of the response of the elevating velocity relative to the operational physical force.
Figure 8:
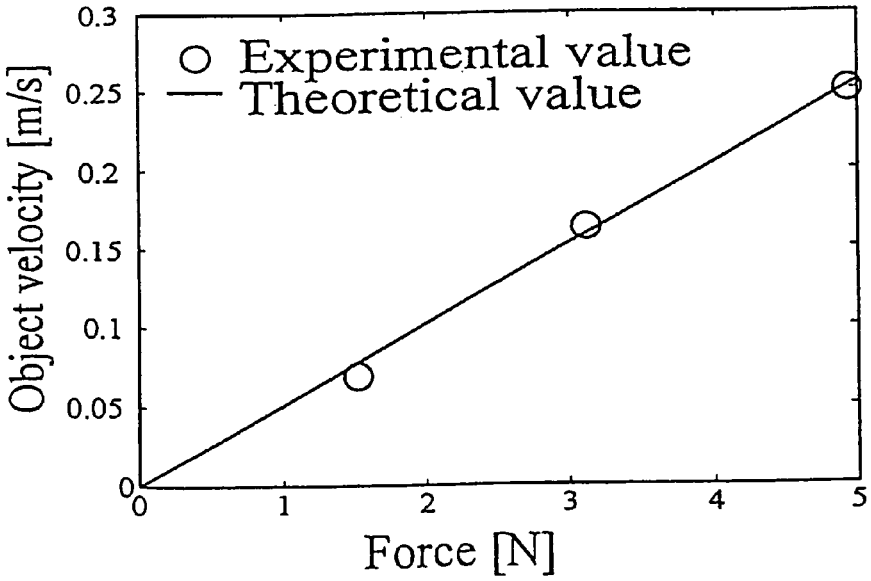
FIG. 8 is a graph showing the experimental values and the theoretical values about the relation between a three-staged constant operating physical force and the transfer velocity due to that force when experimenting on the P control action.
Figure 9:
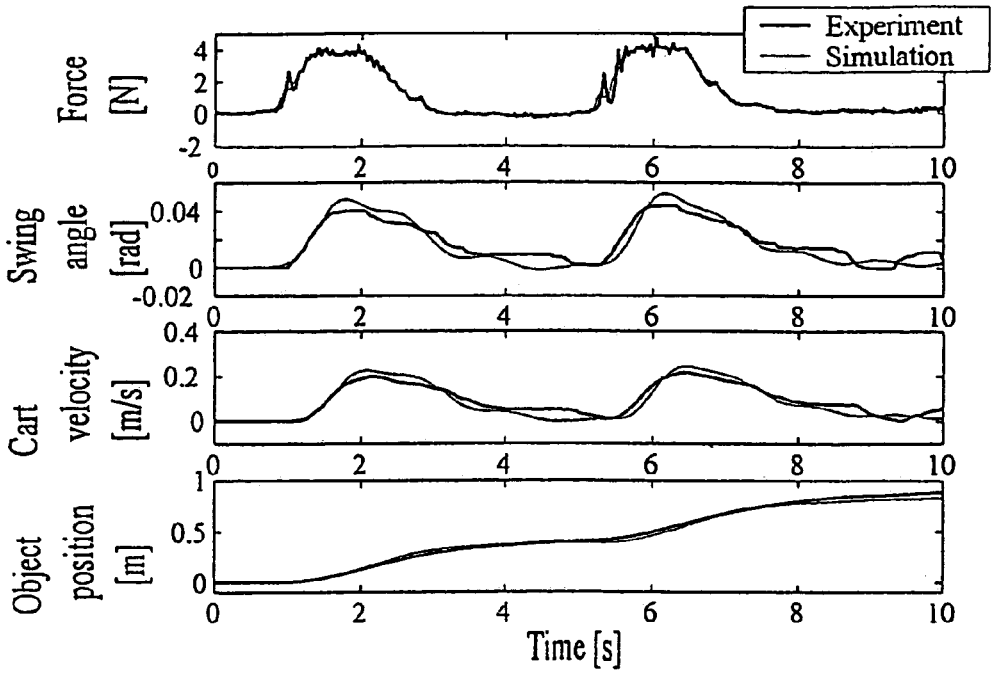
FIG. 9(*a*) is a graph showing an experiment of the transfer of the PD control action, and FIG. 9(*b*) is a graph showing an experiment of the transfer of the PI control action.
Figure 9:
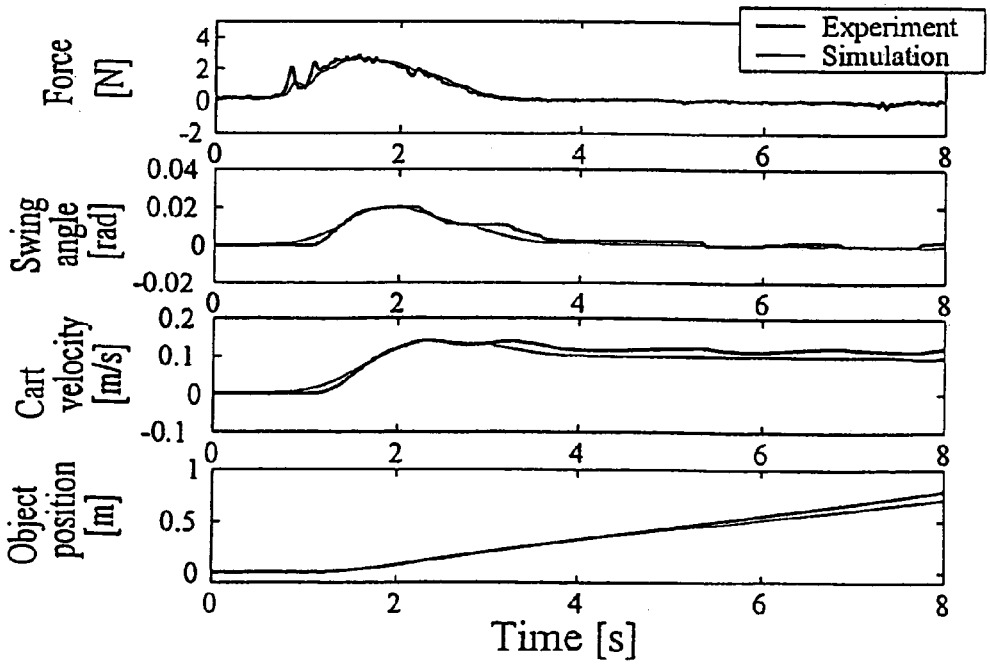
Figure 10:
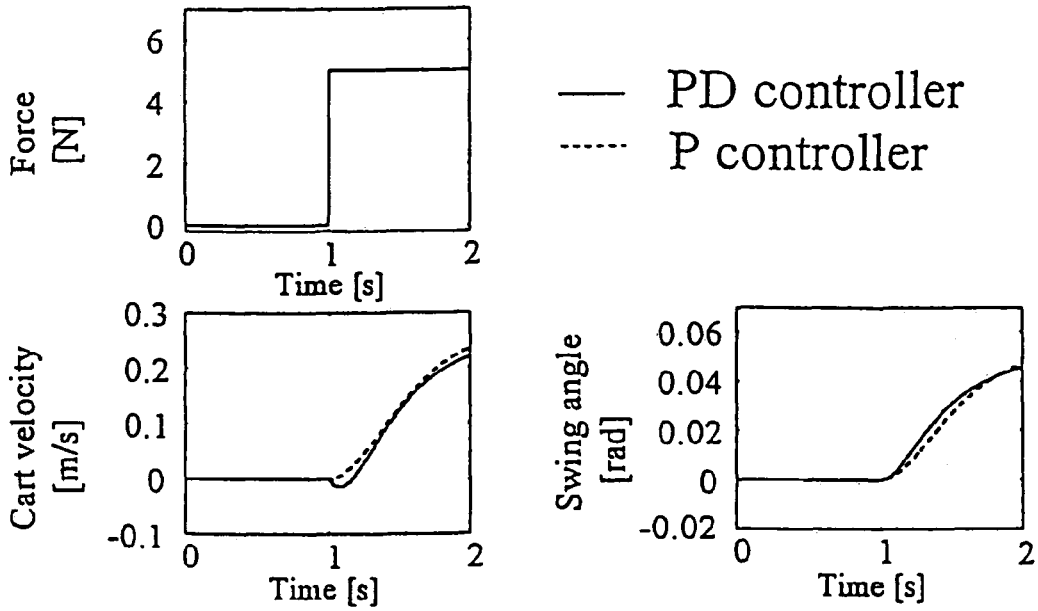
FIG. 10 is a graph showing a simulation of the difference of the behavior of the PI control action and the P control action on the effect of the derivative gain.
Figure 11:
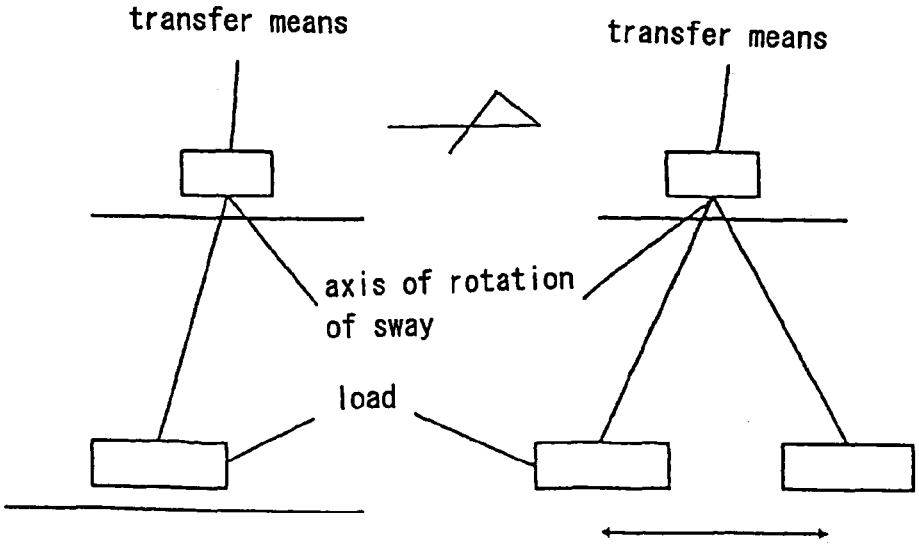
FIG. 11 is an explanatory drawing for the operation of another embodiment of the present invention where the load W is horizontally moved.

What is claimed is:

1. A control system for controlling rotation of a servomotor to vertically move a load supported by a flexible support device, the control system comprising:

a single sensor for:

measuring a force acting on the support device, the force comprising the sum of:

a force caused by a mass of the load;

a force caused by an acceleration of the load; and an externally-supplied user force; and outputting a load signal corresponding to the measured force; and control means for supplying to the servomotor, based on the load signal and a control algorithm, a servomotor drive signal specifying servomotor operating parameters, including a rotational direction and a velocity, sufficient to cause the servomotor to impart to the load via the support device a desired elevating velocity within a desired amount of time;

wherein the control algorithm is expressed as $$K_f = k_p \omega_n^2 / (s^2 + 2\zeta\omega_n s + \omega_n^2),$$

where:

$k_p$ is a transformation coefficient [(m/s/N)], $\omega_n$ is a natural angular frequency [rad/sec], s is a Laplacian operator [1/sec], and $\zeta$ is a damping coefficient.

2. A control system for controlling a traveling crane to horizontally and vertically move a load, supported by a flexible support device, in an desired direction and at a desired velocity, the crane having a servomotor which, when rotated, causes the load to move in a vertical direction and a truck operable to move the load in a horizontal direction, the control system comprising:

single sensor for:

measuring a force acting on the support device, the force comprising the sum of:

a force caused by a mass of the load;

a force caused by an acceleration of the load; and an externally-supplied user force; and outputting a load signal corresponding to the measured force;

first control means for supplying to the servomotor, based on the load signal and a control algorithm, a servomotor drive signal specifying servomotor operating parameters, including a rotational direction and a velocity, sufficient to cause the servomotor to impart to the load via the support device a desired elevating velocity within a desired amount of time;

wherein the control algorithm is expressed as $$K_f = k_p \omega_n^2 / (s^2 + 2\zeta\omega_n s + \omega_n^2),$$

where:

$k_p$ is a transformation coefficient [(m/sec/N)];

$\omega_n$ is a natural angular frequency [rad/sec];

s is a Laplacian operator [1/sec]; and $\zeta$ is a damping coefficient;

length measuring means for measuring the length of the support device from the servomotor to the load and producing a length signal;

weight measuring means for measuring a weight of the load suspended from the support device and producing a weight signal corresponding to the measured weight;

angle measuring means for measuring the angle of the support device relative to a vertical plane when a user laterally pushes the load in a desired horizontal direction, and producing an angle signal corresponding to the measured angle; and second control means for computing operation conditions for the crane based on the length signal, the weight signal, and the angle signal, and outputting to the crane a directional signal to drive the crane in the desired horizontal direction according to the computed operation conditions.

3. The control system of claim 2, wherein an angle of the support device relative to the vertical plane is created when the user laterally pushes the load, or when an axis of rotation of a sway of the support device is located in a position that differs from a position just above the load placed on a floor.

4. The control system of any one of claims 1, 2, and 3, wherein the load is a flask-tight mold weighing from 10 to 500 kg.

* * * * *

UNITED STATES PATENT AND TRADEMARK OFFICE

CERTIFICATE OF CORRECTION

PATENT NO. : 7,832,711 B2
APPLICATION NO. : 11/667940
DATED : November 16, 2010
INVENTOR(S) : Miyoshi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 350 days.

Signed and Sealed this
Third Day of May, 2011

David J. Kappos

David J. Kappos
*Director of the United States Patent and Trademark Office*